US006398351B1

(12) United States Patent
Blum et al.

(10) Patent No.: US 6,398,351 B1
(45) Date of Patent: Jun. 4, 2002

(54) FLUSH SYSTEM FOR INK CHANGE

(75) Inventors: John N. Blum; James A. Katerberg, both of Kettering, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,080

(22) Filed: Dec. 14, 1998

(51) Int. Cl.[7] ..... B41J 2/17; B41J 2/175; B41J 2/18

(52) U.S. Cl. ..... 347/84; 347/85; 347/89

(58) Field of Search ..... 347/28, 84, 85, 347/6, 23, 89

(56) References Cited

U.S. PATENT DOCUMENTS 4,827,278 A * 5/1989 Lecheheb ..... 347/7
5,126,752 A * 6/1992 Weinberg ..... 347/28
5,451,987 A * 9/1995 Perrin ..... 347/6
5,570,116 A * 10/1996 Soga ..... 347/30
5,634,170 A * 5/1997 Knapp et al. ..... 399/29
5,933,689 A * 8/1999 Kim ..... 399/233

* cited by examiner

*Primary Examiner*—John Barlow
*Assistant Examiner*—Alfred Dudding
(74) *Attorney, Agent, or Firm*—Barbara Joan Haushalter

(57) ABSTRACT

A system for flushing ink residue from a fluid system is provided for use with a continuous ink jet print station. Ink is rapidly drained from the fluid system, and the fluid system is refilled with a flush fluid. The flow of flush fluid is directed through all fluid system components which normally contain ink. Subsequently, the flow of flush fluid can be diverted to a waste tank rather than re-circulated into the ink tank.

13 Claims, 3 Drawing Sheets

FLUSH SYSTEM FOR INK CHANGE

TECHNICAL FIELD

The present invention relates to the field of continuous ink jet printing and, more particularly, to the flushing of one ink from a fluid system when replacing it with one of a different color or chemistry.

BACKGROUND ART

Continuous ink jet printers are a substantial capital investment for a printing company. It is therefore desired to maximize the time available for such a system to print. A printer may have a variety of printing jobs, each requiring a different ink. Ink choice may be based on color, permanence or ease of operation. It is therefore desirable that the ink in a continuous ink jet printer may be easily changed, instead of dedicating a printer to each type of ink.

As ink chemistry, in addition to color, may be incompatible between inks, it is desirable to flush the system with a colorless fluid of low surface tension to remove and dilute the old ink, then introduce the new ink.

Existing art requires the operator to perform such tasks as draining the old ink and flush fluid by inserting a tube into a fitting while holding a bucket as the tank drains, disposing of these buckets of waste, and connecting a special manifold in place of the printhead to properly route the fluid. The flush fluid is then circulated and disposed. No provision is made to remove ink trapped in tubing by sending it directly to waste. The flush instead works by successive dilutions of the residual ink.

Another option is to attach a flush system, consisting of tanks of flush fluid, pumps and a waste tank. This involves extra expense for the customer in purchasing the flush system, and the disadvantage of only flushing one fluid system at a time with the flush system.

It is therefore an object of the present invention to provide a means of flushing and changing the ink in a continuous ink jet fluid system.

It is a further object of the present invention to have the flushing include the printhead(s) in a system.

It is yet another object of the present invention to accomplish the flushing with a minimum of auxiliary equipment.

SUMMARY OF THE INVENTION

These objects are met by the fluid system flush technique according to the present invention.

In accordance with one aspect of the present invention, the fluid flush system flushes residual ink from a fluid system to facilitate an ink change. The fluid system may be configured with one or more printheads. In accordance with the present invention, a common flush system is provided to serve all printheads in the multiple printhead configuration. The separate plumbing within each printhead interface controller (PIC) and printhead is, therefore, substantially identical.

Other objects and advantages of the invention will be apparent from the following description, the accompanying drawing and the appended claims.

DETAILED DESCRIPTION OF THE PREFERRED EMBODIMENTS

Figure 1:
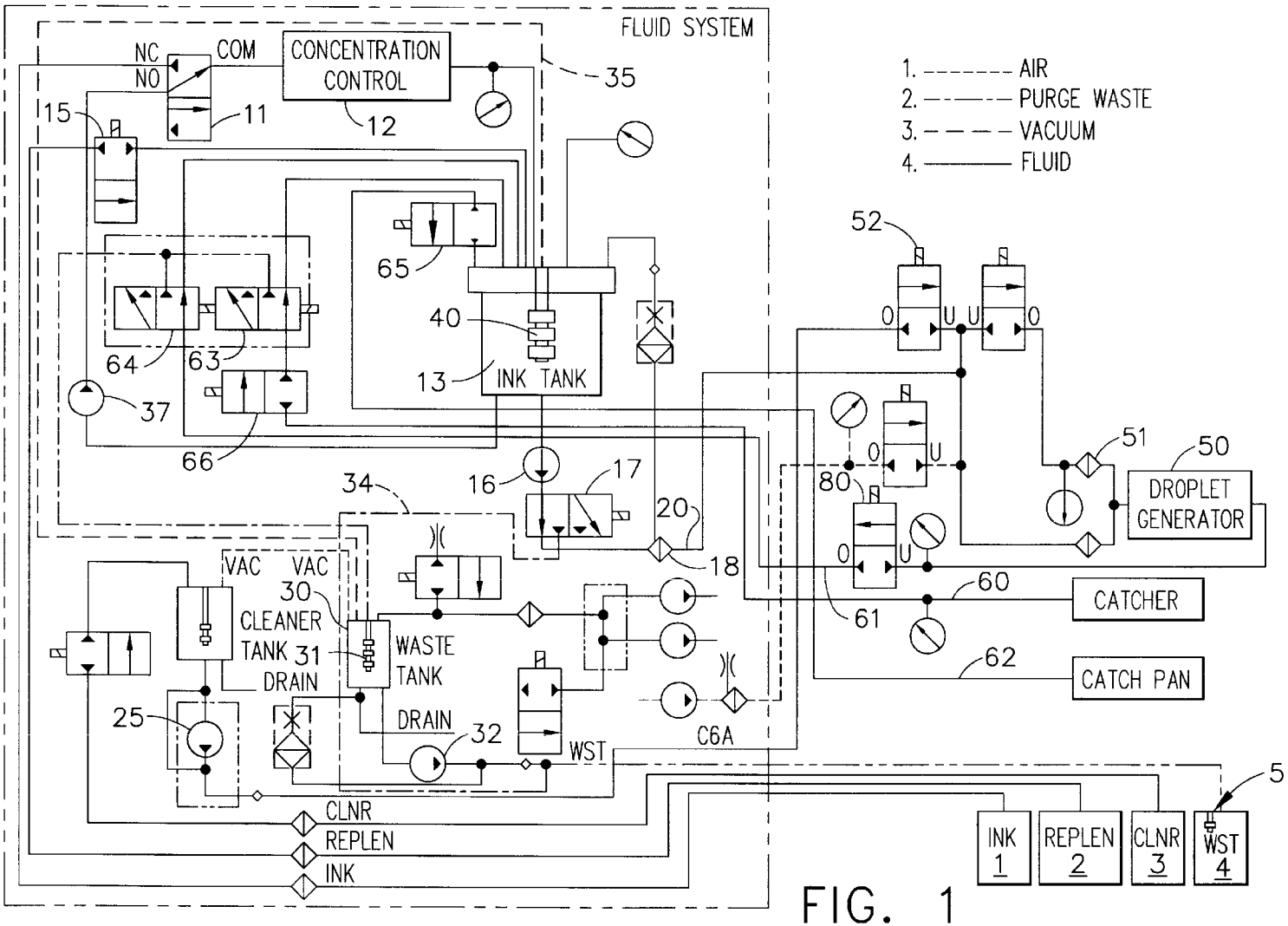
FIG. 1 is a fluid schematic of a fluid system, with printhead interface controllers and printheads.

Referring to FIG. 1, an ink jet print station comprises an external ink supply tank 1, connected through a fill solenoid valve 11 and concentration sensor 12 to ink tank 13. A similar external replenisher tank 2 is connected to a replenisher fill valve 15 and through it into the ink tank. Ink is supplied to the droplet generator 50, by means of a pump 16, through drain valve 17, filter 18, and printhead ink filter 51. The ink which is not used for printing returns to the ink tank via the catcher return line 60, bar outlet line 61, or catch pan line 62. The catcher and bar outlet lines have solenoid valves 63 and 64 which can divert the flow to the waste tank 30. Solenoid valves 65 and 66 serve to start and stop the flow in the catch pan and catcher lines.

A system flush in accordance with the present invention comprises the following steps. Initially, ink is pumped out of ink tank 13 and into the external waste tank 4 by pump 16, via drain control valve 17 and waste line 34. As the intent of this step is to totally drain the ink tank, the float switch, 40 which during normal operation would turn off the ink pump when the ink level is too low, is disabled. Instead, the ink pump is turned on until the ink level is below the lowest float switch, then remains on for a defined time to totally drain the tank. Catcher and catch pan valves 66 and 65 are left open, allowing residual ink to drain into the tank, which is under vacuum. Prior to pumping out the ink tank, a float switch 5, in the external waste tank, is checked to ensure adequate room for the waste ink. This occurs before every draining of the ink tank. If the tank is found to be full, the system displays a warning message to the operator and waits for the tank to be emptied or replaced.

Figure 2:
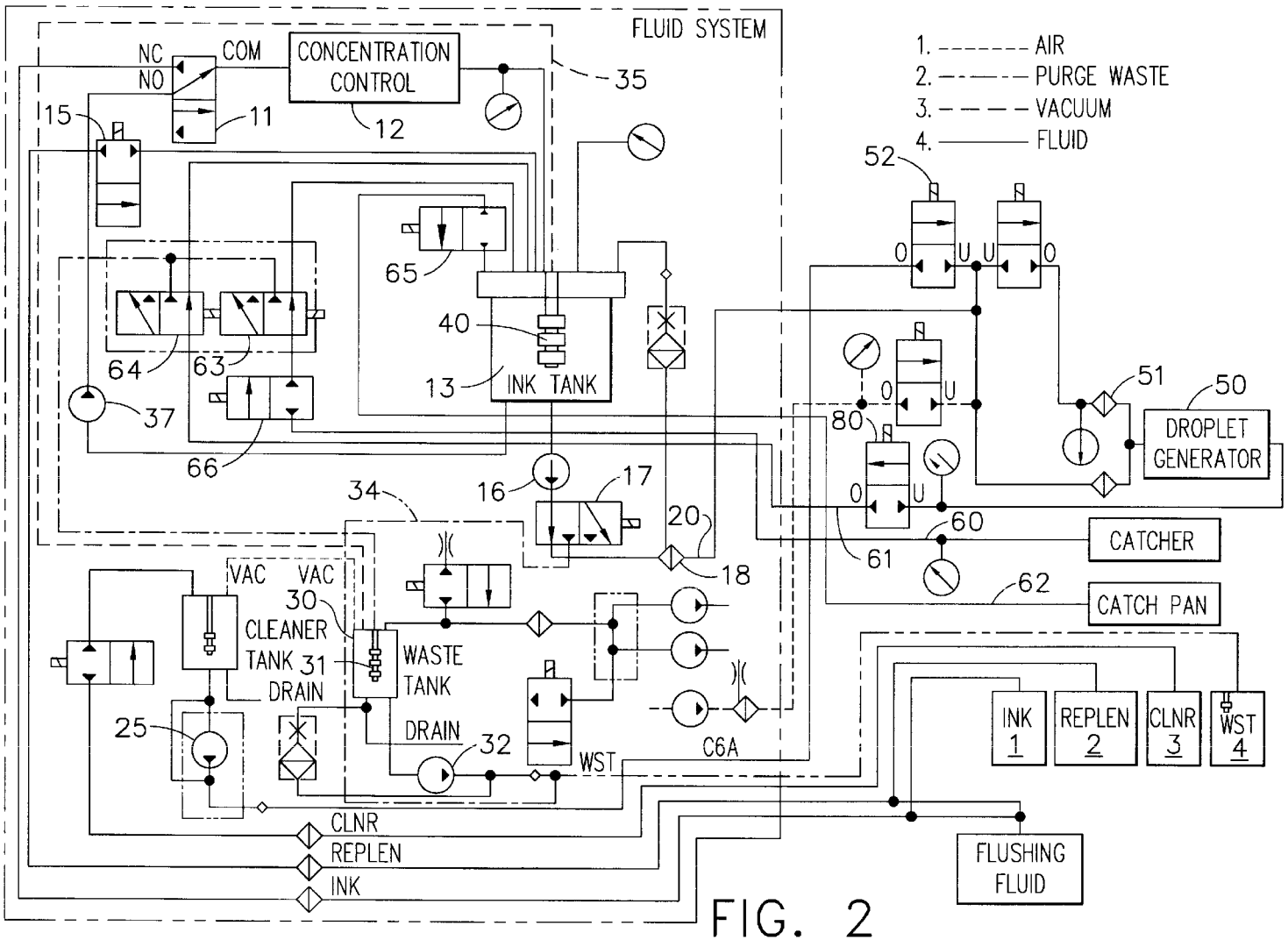
FIG. 2 illustrates the flush fluid supply connected to both the ink and replenisher fill ports.

Either before initiating the flush sequence or while draining the ink from the ink tank, the operator must disconnect the refill lines from the ink supply and replenishment supply vessels, 1 and 2. These refill lines are tee'd together and connected to the flush fluid supply vessel as shown in FIG. 2.

In a second step, the ink tank is refilled with flush fluid through both the ink and replenisher fill valves. During the refill with flush fluid, the float switches in the ink tank are ignored. As a result, the ink tank refill is allowed to continue filling until the ink tank overflows via the vacuum line 35 into internal waste tank 30. The refilling is finally stopped when the lowest switch on the float switch assembly 31 of the internal waste tank 30 is tripped. Overfilling the ink tank ensures that dried residue on the tank walls, above the normal fill line, will wet out and dissolve. In filling the ink tank 13 with flush fluid, both ink refill and replenishment lines are used to speed the filling process. Refilling through the ink refill line alone is quite slow as the optical concentration sensor assembly 12, as disclosed and claimed in co-pending, commonly assigned patent application Ser. No. 09,211,035 restricts its flow. Using both fill lines also ensures that both fill lines are appropriately flushed.

The third step of the system flush circulates the flush fluid to the printhead, while the bar out control valve 64 and catcher 63 waste valves divert the returning fluid to the internal waste tank 30. The internal waste tank is pumped out to the external waste tank 4 as needed by waste pump 32. The fluid is circulated with the drop generator in crossflush, returning flush fluid down the bar outlet line 61 and the catcher line 60. The fluid is also circulated with ink jets formed by closing crossflush valve 80, returning flush fluid down the catcher line when the eyelid is closed or the catch pan line 62, when the eyelid is open. As ink residue may accumulate in the crevices of valves and o-rings, it is desirable to alternate the return fluid flow through these flow paths to ensure proper cleaning. The ink tank is refilled as needed, as controlled by the normal ink tank float switch, with fresh flush fluid to prevent the tank from emptying completely. This flushing of the printhead, while the alternating flush fluid return paths is done for approximately 3 minutes to remove the bulk of the ink remaining in the umbilical line 20.

The bar out 64 and catcher 63 waste valves are then returned to their normal operating condition. This allows the flush fluid to circulate back to the ink tank for approximately 2 minutes, cleaning the other side of the bar outlet waste valves. The umbilical heater (not shown) is also turned on in this state to warm the flush fluid, aiding in redissolving deposits. While the flush fluid is circulated to the ink tank, the optical concentration sensor (OCS) supply pump 37 is turned on to flush out the OCS supply line and pump.

After this circulation step, the printhead purge pump 25 and valve 52 are activated to purge the air filter in the printhead. The filters are allowed to soak in the purge fluid for a few seconds, followed by another cycle of purge fluid.

In the next step, the tank is drained as in step 1, and steps 2 through 6 are then repeated with clean flush fluid. The number of times the tank is drained and refilled with the flush fluid during the flush cycle may vary with the different ink changeovers. For example, ink with a higher degree of incompatibility may require more flushes. Similarly, lighter color inks, such as a yellow ink, may require additional fill and circulate cycles with flush fluid to dilute and remove traces of black ink. On the other hand, a black ink may only require one cycle of flush fluid as its dark color masks lighter inks. The number of flush cycles to employ is normally decided by the controlling software. The operator may however, elect to repeat the flush cycle if deemed necessary. Alternatively, during step 5 as described above, when the flush fluid is circulated through the OCS, the OCS can monitor the tint or color of the flush fluid to determine the necessary number of flush cycles. Typically, two draining and refilling flush cycles are sufficient. After the appropriate number of flush cycles are complete, the fluid system ink filters 18 are replaced with clean filters. The flush fluid supply is then disconnected from the ink and replenishment fill lines.

Figure 3:
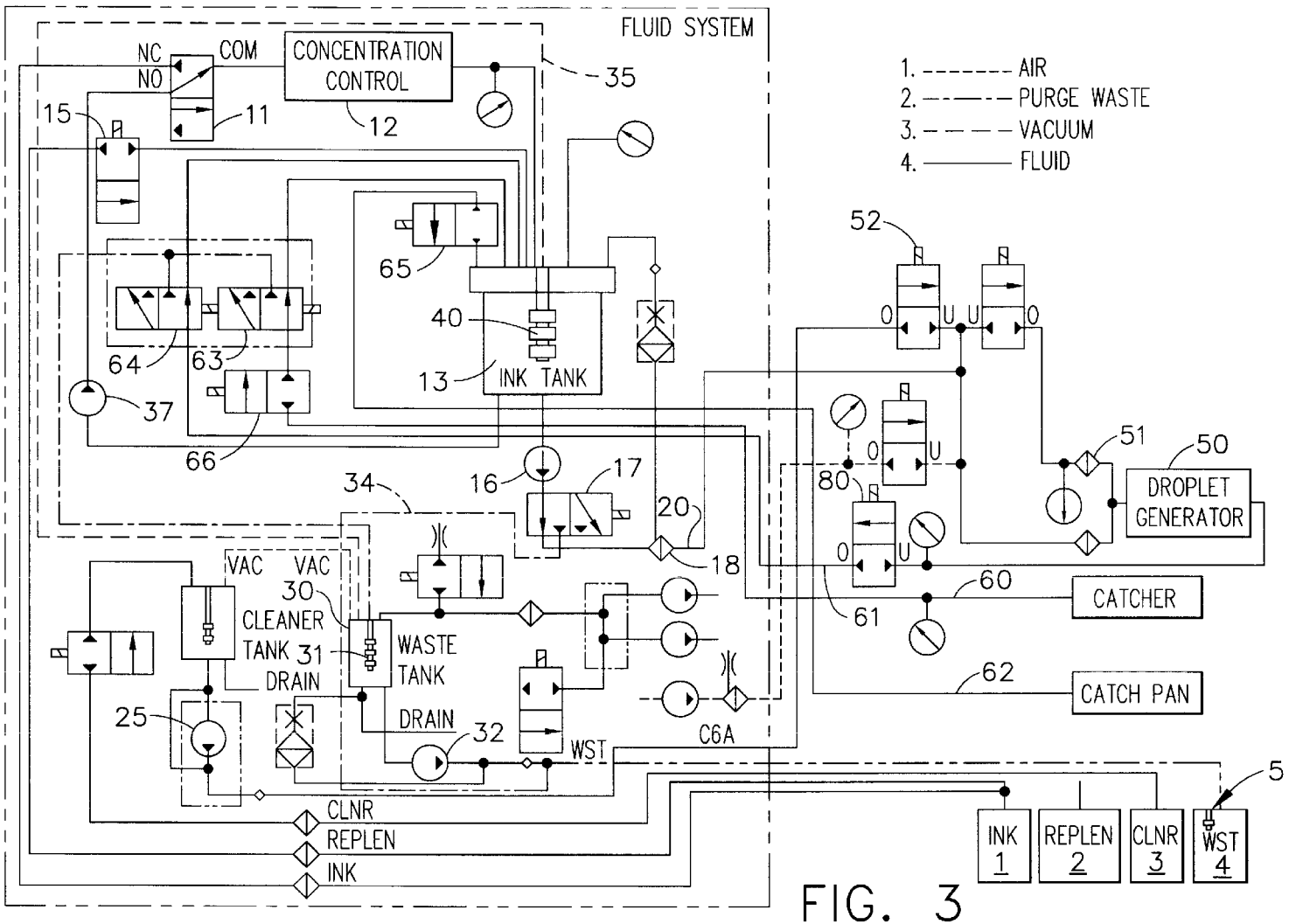
FIG. 3 illustrates the ink supply connected to both the ink and replenisher fill ports.

In the final step, both the ink and replenisher fill ports are connected to the ink supply tank, as shown in FIG. 3. The system is now filled with ink and circulated as in steps 3 through 5. The ink fill is controlled by the normal float switches in the ink tank. The ink is drained and refilled, and circulated again per steps 3 through 5. The ink is drained from the system, the replenisher line is connected to the replenisher fill port, and the system is filled with ink a final time through the ink fill valve and OCS.

In a preferred embodiment of the present invention, the flush fluid used is a clear fluid, so as not to leave residue to tint light colored ink. It may also have a high pH to be compatible with the inks used in continuous ink jet systems. The flush fluid may also contain surfactants to lower the surface tension to aid in wetting out filters and other components. Finally, the flush fluid may or may not be the same as the cleaning fluid used in shutting down a printhead, such as is disclosed and claimed in co-pending, commonly assigned patent application Ser. No. 09,211,213, The only additional component used to perform the flush according to the present invention is a "tee", as shown in FIGS. 2 and 3, to connect flush fluid or ink supply vessels to both the ink refill and replenishment fill ports. The pumps and valves used in the flush perform other uses such as ink circulation and shutdown cleaning in the fluid system. The flushing feature does not require manually draining of the tanks, the use of printhead simulators, external flush systems or external vacuum systems. Control of this flushing sequence is carried out by the fluid system controller which controls the normal ink jet operation of the fluid system (not shown).

The invention has been described in detail with particular reference to certain preferred embodiments thereof, but it will be understood that modifications and variations can be effected within the spirit and scope of the invention. Although this description has referenced the components for a single printhead in a multiple printhead fluid system, it should be understood that the flush system would concurrently flush the matching components for the second, or multiple, printhead(s). The invention is also applicable to single printhead fluid systems or fluid systems operating more than one printhead.

What is claimed is:

1. A system for flushing ink residue from a fluid system of a continuous ink jet print station having an ink tank, the system comprising:

means for quickly draining ink from the fluid system;

means for filling the fluid system with flush fluid;

means for directing the flow of the flush fluid through all fluid system components which normally contain ink;

means for diverting flow of the flush fluid to waste alternately opening and closing valves to clean all portions of said valves; and a concentration sensor associated with the fluid system to check cleanliness of the fluid system and generating an output which indicates a necessary number of times the system should repeat the operation.

2. A system as claimed in claim 1 further comprising means for rinsing an inside of the ink tank.

3. A system as claimed in claim 2 wherein the means for rinsing comprises a flush fluid overflow in the ink tank and through a vacuum port of the ink tank.

4. A system as claimed in claim 1 wherein the means for quickly draining the ink tank comprises means for diverting ink from an ink pump outlet to a waste fluid tank.

5. A system as claimed in claim 1 wherein the means for filling the fluid system with flush fluid comprises means for filling through replenishment and ink refill ports of the fluid system.

6. A system as claimed in claim 1 wherein the means for directing flow of the flush fluid comprise means for pumping flush fluid to the printhead.

7. A system as claimed in claim 1 wherein the means for directing flow of the flush fluid comprises means for returning flush fluid from the printhead through all printhead return lines.

8. A system as claimed in claim 1 wherein the means for diverting flow of the flush fluid to waste comprises means to divert all flush fluid returning from the printhead to waste.

9. An improved system to flush an ink jet fluid system to facilitate an ink change, the ink jet fluid system having a printhead and further having an associated ink tank and an associated waste fluid tank, the ink tank having an inside surface, comprising:

means to quickly drain ink from the ink tank into a waste fluid tank;

means to rinse an inside surface of the ink tank;

means to divert fluid returning from the printhead to a waste fluid tank;

control means to control an operating sequence of the flush system; and a concentration sensor associated with the fluid system to check cleanliness of the fluid system and generating an output which indicates a necessary number of times the system should repeat the operation.

10. An improved means as claimed in claim 9 wherein the means to quickly drain comprise an ink pump and a valve for diverting flow to a waste tank.

11. An improved means as claimed in claim 9 wherein the means to rinse comprise means for overflowing the ink tank through a vacuum line.

12. An improved means as claimed in claim 9 wherein the means to divert comprise at least one valve.

13. An improved means as claimed in claim 9 wherein the control means comprise an existing fluid system controller.

* * * * *